United States Patent [19]

Hughes

[11] Patent Number: 4,473,339

[45] Date of Patent: Sep. 25, 1984

[54] LIQUID PUMP

[76] Inventor: Cecil Hughes, 3 Manor Pl., Frenchay, Bristol BS161PS, England

[21] Appl. No.: 375,295

[22] Filed: May 5, 1982

[51] Int. Cl.[3] ..... F04F 7/00

[52] U.S. Cl. ..... 417/240; 447/479

[58] Field of Search ..... 417/240, 241, 566, 479, 417/481–484

[56] References Cited

U.S. PATENT DOCUMENTS 3,424,096 1/1969 Hughes ..... 417/244

FOREIGN PATENT DOCUMENTS 515385 8/1955 Canada ..... 417/286
125508 4/1919 United Kingdom ..... 417/483
216817 6/1924 United Kingdom ..... 417/483
543248 2/1942 United Kingdom ..... 417/483
993895 6/1965 United Kingdom ..... 417/479

*Primary Examiner*—William L. Freeh
*Attorney, Agent, or Firm*—Hopgood, Calimafde, Kalil, Blaustein & Judlowe

[57] ABSTRACT

A liquid pump comprises two flexible impulsion members disposed in series between inlet and outlet openings of the pump casing. The members are engageable with sealing means to form an intermediate chamber in the casing between the inlet and outlet. Both members are connected to a common pivot shaft which is rocked to reciprocate the members 180° out of phase in order to drive liquid through the pump. The pivot shaft is sealed from the exterior by torsionally flexible sleeves clamped at opposite ends to the shaft and to the casing.

8 Claims, 2 Drawing Figures

LIQUID PUMP

FIELD OF THE INVENTION

This invention relates to pumps, and in particular to pumps in which one or more flexible impulsion members are reciprocable to generate a flow of liquid between the inlet and outlet of the pump.

Pumps of this form are known in which two flexible impulsion members are disposed in series within the pump casing between the pump inlet and outlet to define between them an intermediate chamber of the flow path through the casing and said members are reciprocated out of phase with each other by axially displaceable drive rods. Sealing faces, on which the free rims of the impulsion members can bear, both face in the downstream direction of the fluid flow past their respective impulsion members such that as the upstream member moves away from its sealing face in one part of the cycle of reciprocation it draws liquid through the inlet into the intermediate chamber, while in the other part of the cycle the downstream member moves away from its sealing face to draw liquid from the intermediate chamber and drive it through the pump outlet.

These pumps are able to deal with a wide variety of liquids, and in particular with liquids that have solid matter in suspension.

Examples of such pumps are described in U.K. Pat. Nos. 539247 and 1399742 in which the linearly reciprocable drive rods extend into the pump casing through sliding seals. However, such an arrangement is vulnerable to wear while pumping dirty or corrosive liquids and the seals may have to be frequently maintained if leakage from the pump cannot be tolerated.

In another known pump (U.K. Pat. No. 1159382) such sliding wear is avoided by employing tubular sealing sleeves fixed at their ends to the static casing and the linearly reciprocating drive rods. These sleeves are therefore each put alternately into tension and compression as the drive rods reciprocate, and are thereby subjected to substantial stresses which can severely shorten their working life.

In these earlier pump constructions, moreover, the provision of oppositely reciprocating drive rods creates a relatively cumbersome layout increasing the size of the pump casing and consequently adding both to the costs of the construction and the final weight of the pump.

SUMMARY OF THE INVENTION

According to the present invention, there is provided a pump having within its casing at least one flexible impulsion member arranged to be reciprocated towards and away from a sealing means to generate a flow through the pump past said sealing means, wherein the member is driven by a shaft pivotally supported in the casing and having a radially projecting rocker arm attached to said at least one impulsion member.

Preferably, there are two said impulsion members connected to said pivot shaft and disposed serially along said fluid flow path within the housing, respective sealing means for the members each comprising a sealing surface facing the downstream direction of the fluid flow past its member.

In a pump according to the invention it is possible to avoid the use of sliding seals for the pivot shaft, while at the same time employing flexible sealing members that are relatively lightly loaded, by providing sealing means between the pivot shaft and the casing wall in the form of at least one flexible member having two spaced peripheral regions secured one to the shaft and the other to the housing, said member flexing in torsion as the shaft pivots. Conventional rotary bearings can then be provided for the pivot shaft outside the fluid-filled spaces of the pump, protected from damage or corrosion from the material being pumped.

An embodiment of the invention will be described in more detail with reference to the accompanying drawings

DESCRIPTION OF THE PREFERRED EMBODIMENT

Figure 1:
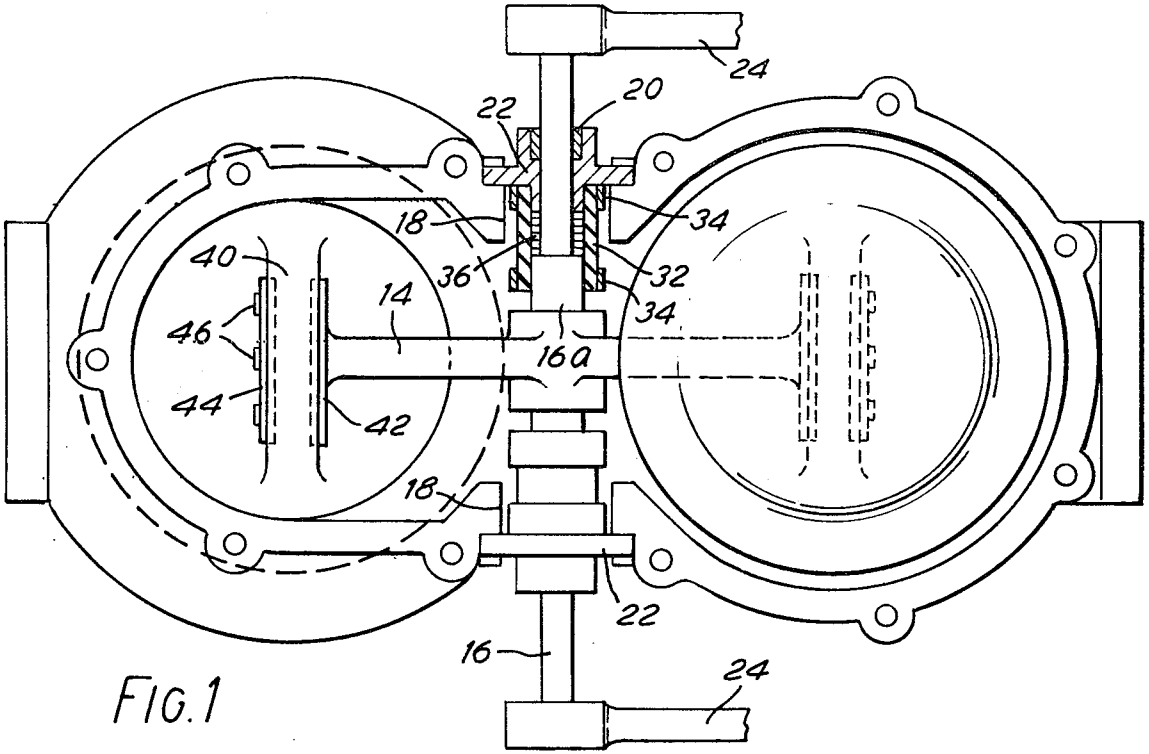
FIG. 1 is a plan section of a pump according to the invention on the line I—I in FIG. 2.

The pump in the drawings has a main casing 2 formed by a plurality of cast or moulded parts bolted together and in which inlet and outlet openings 4,6 are provided at the ends of an internal throughflow passage defined therein. Between the openings 4,6, two circular seal seatings 8 are formed within the casing and respective disc-like impulsion members 10 of a flexible material, e.g. a neoprene rubber, can seal against these seatings to form a closed intermediate chamber 12 inside the pump. These members are mounted on opposite ends of a radial arm 14 secured at its centre to a pivot shaft 16 that extends transversely through opposed walls of the casing to project through bores 18 opposite sides of the casing and be supported on pivot bearings 20 mounted in bushings 22 bolted to the casing.

Figure 2:
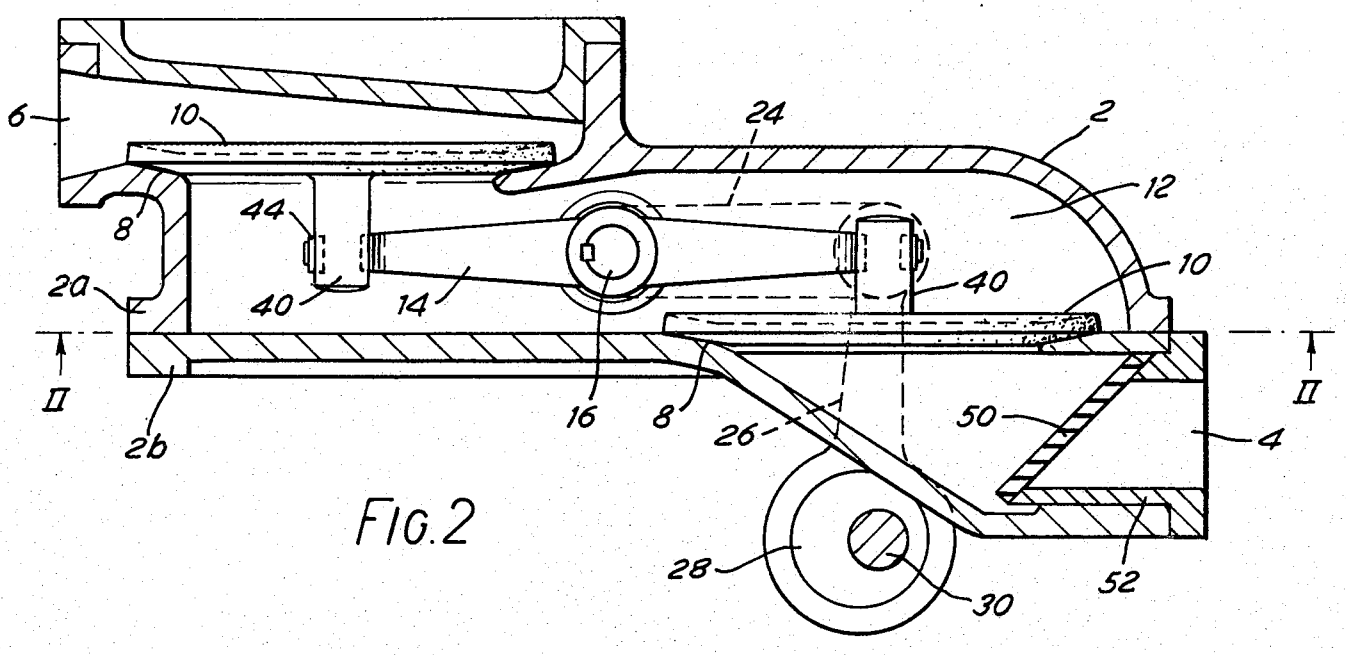
FIG. 2 is an elevational section of the pump on the line II—II in FIG. 1.

Fixed to the projecting ends of the shaft are crank arms 24, each pivoted to one end of a connecting rod 26 (FIG. 2). Both connecting rods are supported at their other ends on corresponding eccentrics 28 fixed at spaced positions on a common rotary input shaft 30 and the connecting rods thus move together with an oscillating motion as the input shaft, driven by a prime mover (not shown), rotates the eccentrics. The stroke of the radial arm can be modified by changing the eccentrics 26, and it is also possible to introduce a variable stroke mechanism. The motion of the connecting rods is translated by the crank arms into a pivoting oscillation of the pivot shaft, which results in the impulsion members being reciprocated up and down in opposite directions to each other, the volume of the intermediate chamber alternately expanding and contracting with these movements.

Since the seatings both face in the same, downstream direction, the result is obtained that as one member moves towards its seating to prevent further flow in or out of the pump, respectively, the other member moves away from its seating to express liquid from the pump or draw further liquid in, respectively. A pulsed unidirectional flow is obtained from inlet to outlet and, in fact, at higher speeds of reciprocation the inertia effect of the column of water moving through the pump may allow the flow to be maintained without either impulsion member sealing fully, thus smoothing the flow pulses.

In order to protect the bearings 20 of the pivot shaft against damage from the materials being pumped and to prevent leakage through the joints between the shaft and the casing, a positive sealing means is provided between the shaft and each of the opposed casing walls, while the pivot bearings are disposed to the exterior of these seals.

The sealing member of each of said seals is in the form of a flexible tube 32 of an elastomeric material, capable of being torsionally deformed about its axis. Hose clips 34 clamp one end of the tube to the adjoining bearing bushes 22 fixed to the pump casing and the other end of the tube to an increased diameter portion 16*a* of the pivot shaft whereby a radial working clearance is formed between each tube and the shaft. Between the two clamped ends, an annular space between the shaft and the tube may be occupied by one or more radial support rings 36, preferably of a low-friction material such as polytetrafluorethylene, which serve to prevent collapse of the tube due to high pressures occurring within the intermediate chamber.

A relatively small angular movement of the pivot shaft, e.g. less than 10°, can be sufficient to give the required linear displacement to the impulsion members so that the flexible tubes are not subjected to large strains as they are torsionally deformed. In fact, the angular deformation of the sleeves in each direction from a central position is only one half the angular movement of the pivot shaft.

The impulsion members have integrally moulded fins or lugs 40 by means of which they are secured to the ends of the radial arm 14. Each such lug 40 extends transversely to the arm 14 over a major part of the diameter of its impulsion member and is clamped against a transversely extending end plate 42 on the radial arm by a clamping bar 44 and a series of bolts 46 extending through the bar into the end plate.

This arrangement for the support of the impulsion plates with the lugs themselves having some flexibility, allows a limited degree of movement of the main disc-like portion of each plate towards and away from the pivot shaft axis so as to compensate, if needed, for the slight radial displacements that occur due to the fact that the ends of the radial arm do not follow a pure linear motion.

At the inlet to the pump a flap valve 50 may be provided in a tubular insert 52 to assist in priming the pump when starting. After starting the pump, valve will normally be held open by the liquid moving through the pump. In the event that solid materials impede the movement of the impulsion members to the extent that the flow through the pump is stopped, the inlet valve will again close and resume its priming function, which will then generate fluid pressures acting to remove the blockage. Additionally or alternatively to the inlet valve there may be an outlet flap valve provided for a similar purpose.

The construction provides a very simple arrangement with a long service life, while the interior of the pump can be made readily accessible, e.g. for replacement of the impulsion members, by forming the main casing, as illustrated, from two principal castings or mouldings 2*a*, 2*b* detachably bolted together. The complete sealing of the pump interior from the pivot shaft bearings means that, with suitable choice of materials for the internal parts, dirty and corrosive liquids can be pumped.

The illustrated construction can be modified in many ways within the scope of the invention. For example, the pivot shaft can be overhung, projecting into the casing interior from one side only through a bushing that preferably carries two spaced bearings to journal the shaft sufficiently rigidly; whether or not this is done, it is also possible to drive the pivot shaft from one end only. In another modification, the flexible sealing members for the pivot shaft can have flanged ends which are sealingly clamped against annular end faces provided on the casing wall or bushing and the shaft respectively.

What is claimed is:

1. A pump comprising a casing having inlet and outlet openings and an interior space within the casing providing a flow path for liquid through the pump, at least one flexible impulsion member in said flow path and sealing means cooperating with said member, drive means connected to said impulsion member for reciprocation of said member towards and away from said sealing means to generate a flow along said flow path through the pump past said sealing means, said drive means for the member comprising a shaft, support means in the casing for the shaft for pivotal movement of said shaft, a radially projecting rocker arm projecting from said shaft and attached to said at least one impulsion member, and sealing means between the pivot shaft and a wall of the casing bounding said flow path, said sealing means comprising a flexible member having two spaced peripheral regions secured one to the shaft and the other to the casing.

2. A pump according to claim 1 wherein rotary bearing means for the pivot shaft is disposed externally of said sealing means.

3. A pump according to claim 1 wherein said flexible member is in the form of a tubular sleeve and said peripheral regions are provided at opposite ends of the sleeve.

4. A pump according to claim 3 wherein the sleeve internal diameter is larger than the shaft external diameter over at least a part of the axial extent of the sleeve, and radial support means are disposed between the shaft and the sleeve for supporting the sleeve against internal pumping fluid pressure forces exerted upon it.

5. A pump according to claim 1 wherein said at least one impulsion member comprises a main disc-like portion for co-operation with the sealing means and an integral lug projecting from said main portion for securing the member to said rocker arm, said lug providing a flexible connection between said arm and the main disc-like portion.

6. A pump according to claim 5 wherein said flexible connection provided by the lug is operative to permit movements substantially longitudinally of the rocker arm.

7. A pump according to claim 1 wherein there are two said impulsion members connected to said pivot shaft and disposed serially along said fluid flow path within the casing, respective sealing means for the members each comprising a sealing surface facing the downstream direction of the fluid flow past its member.

8. A pump according to claim 7 wherein said impulsion members are disposed at substantially 180° to each other relative to the axis of the pivot shaft.

* * * * *